US006497766B1

(12) United States Patent
Schang et al.

(10) Patent No.: US 6,497,766 B1
(45) Date of Patent: Dec. 24, 2002

(54) ELECTROSTATIC SPRAY FIXTURE FOR PLASTIC TEST PANELS

(75) Inventors: Craig S. Schang, Madison Heights, MI (US); William H. Merritt, Ferndale, MI (US); John D. McGee, Avon, IN (US); Daniel T. St. Dennis, Waterford, MI (US)

(73) Assignee: BASF Corporation, Southfield, MI (US)

( * ) Notice: Subject to any disclaimer, the term of this patent is extended or adjusted under 35 U.S.C. 154(b) by 96 days.

(21) Appl. No.: 09/619,194

(22) Filed: Jul. 19, 2000

(51) Int. Cl.[7] ..... B05C 13/00
(52) U.S. Cl. ..... 118/500; 118/503
(58) Field of Search ..... 118/500, 503, 118/620, 621; 204/298.15; 361/799; 174/51; 439/92

(56) References Cited

U.S. PATENT DOCUMENTS

| | | | | | |
|---|---|---|---|---|---|
| 3,609,631 | A | * | 9/1971 | Looney et al. | 439/100 |
| 4,186,981 | A | * | 2/1980 | Holton | 439/786 |
| 4,828,504 | A | * | 5/1989 | Franks, Jr. | 439/92 |
| 5,164,011 | A | * | 11/1992 | Ray | 118/500 |
| 5,830,274 | A | * | 11/1998 | Jones et al. | 118/620 |

* cited by examiner

*Primary Examiner*—Laura Edwards
(74) *Attorney, Agent, or Firm*—Ryan W. Massey

(57) ABSTRACT

A test fixture is provided which is capable of holding test panels in a curved repeatable position relative to a spray gun. The test fixture holds a plastic test panel in such a position as to provide a gauge to measure the amount of electrostatic wrap potential a coating has.

15 Claims, 3 Drawing Sheets

ELECTROSTATIC SPRAY FIXTURE FOR PLASTIC TEST PANELS

FIELD OF THE INVENTION

The present invention relates generally to electrostatic paint spraying techniques, and more particularly to a test fixture used to provide a gauge to measure the amount of electrostatic wrap potential of a coating.

BACKGROUND

The automotive industry, as well as other industries, are increasingly using plastics for reducing weight, enhancing performance, and for improving the appearance of their products. With the increased use of plastics, new paints and coatings have been required in order to provide better performance and a refined appearance to the plastic articles such as vehicle body panels. In the development and testing of these new paint products, the paints are applied to plastic test panels and are tested for various features such as weathering, flexibility, scratch resistance, vulnerability to temperature variations, etc.

Electrostatic painting techniques are used to increase the efficiency of the amount of paint that transfers to the part. The use of non-electrostatic coating techniques typically results in approximately 15 to 40 percent of the coating actually adhering to the painted article while with electrostatic painting techniques, approximately 45 to 75 percent or more of the coating typically adheres to the product. With electrostatic painting techniques, the spray direction of the coating does not need to be directly at the surface of the part in order to yield a coated surface. In other words, the electrostatic coating techniques provide a static-electric charge to the coating particles so that they are attracted toward the part even if they are not sprayed directly at the part. Different coatings have a different electrostatic wrap potential. The electrostatic wrap potential is the ability of the coating to cover a surface which is not in a direct line of spray during the painting application process. Previously, there was no method of quantifying the electrostatic wrap potential for a coating other than by actually spraying pieces of fascia or other vehicle body components. Accordingly, it is an object of the present invention to provide a method of measuring electrostatic wrap potential using standard test panels.

SUMMARY OF THE INVENTION

The present invention allows lab personnel to measure electrostatic wrap potential with standard test panels. A test fixture is provided which is capable of holding test panels in a fixed repeatable position relative to a spray gun. The test fixture holds a plastic test panel in such a position as to provide a gauge to measure the amount of electrostatic wrap potential a coating has. These and other objects of the present invention are obtained by providing an electrostatic spray fixture for test panels, including a base member having a curved surface adapted to support a test panel thereon and a ground member disposed on the curved surface. The base member includes a slot disposed at one end of the curved surface and adapted for receiving a first end of a test panel. A clamp is mounted at a second end of the curved surface and is adapted to receive a second end of a test panel. The ground member is connected to a ground wire and clamp.

The method of testing the amount of electrostatic wrap of the coating includes the steps of mounting a test panel on the curved surface of the fixture and spraying an electrostatic coating at the test panel such that the curved surface has a forward portion closest to a spraying device in a direct path of the sprayed electrostatic coating, the curved surface further including a rearward portion further from the spraying device which is not in a direct spray path of the sprayed electrostatic coating wherein an amount of coating that adheres to the test panel covering the rearward portion of the curved surface can be used to quantify the electrostatic wrap of the coating.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
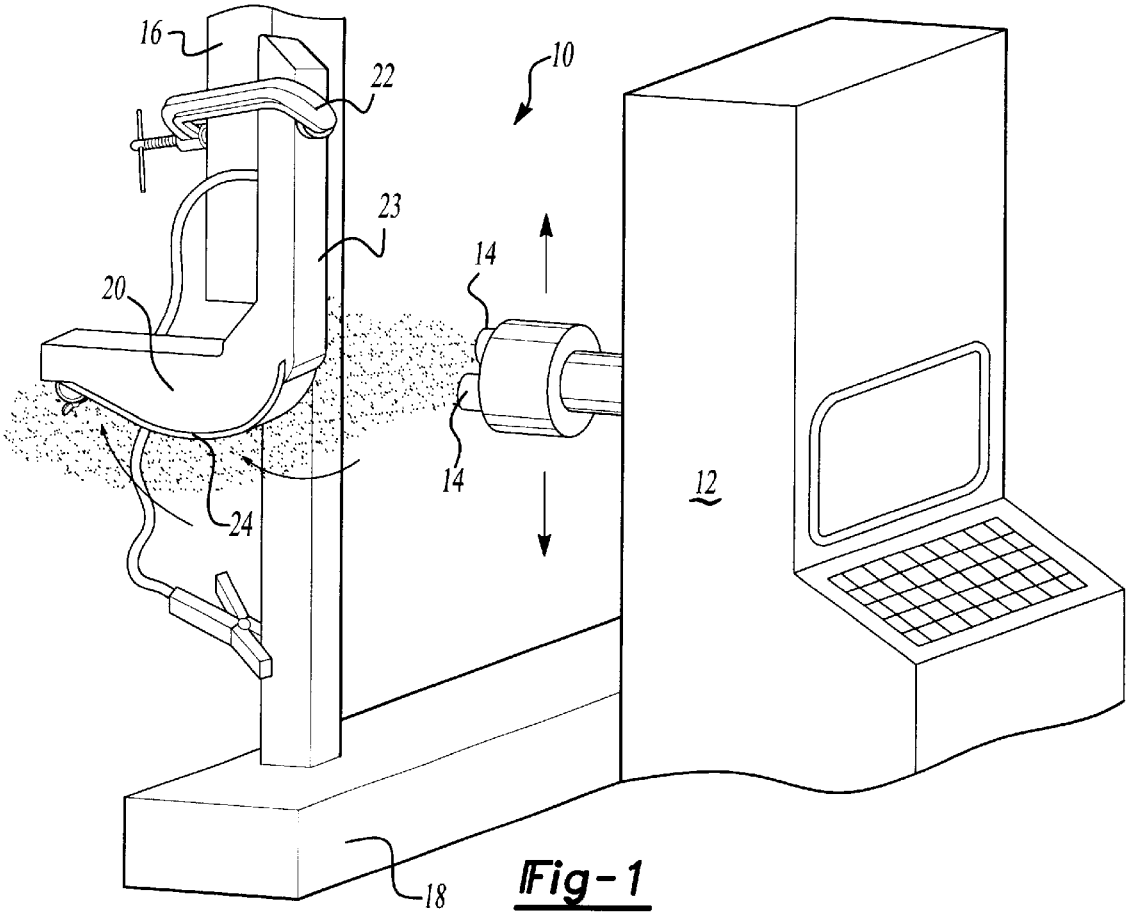
FIG. 1 is a perspective view of an electrostatic paint application system including a spray target which is movable along a conveyer system and has a test fixture according to the principles of the present invention mounted thereon.

With reference to FIGS. 1–6, the electrostatic spray test fixture, according to the principles of the present invention, will now be described. FIG. 1 illustrates an electrostatic spray application system 10. The spray application system 10 includes a control module 12 which controls the electrostatic sprayers 14 directed toward a spray target 16. The spray target 16 is mounted to a conveyer system 18 along which the spray target 16 travels in a direction transverse to the spray direction of the sprayers 14. The test fixture 20, according to the principles of the present invention, is mounted to the spray target 16 by a C clamp 22.

Figure 2:
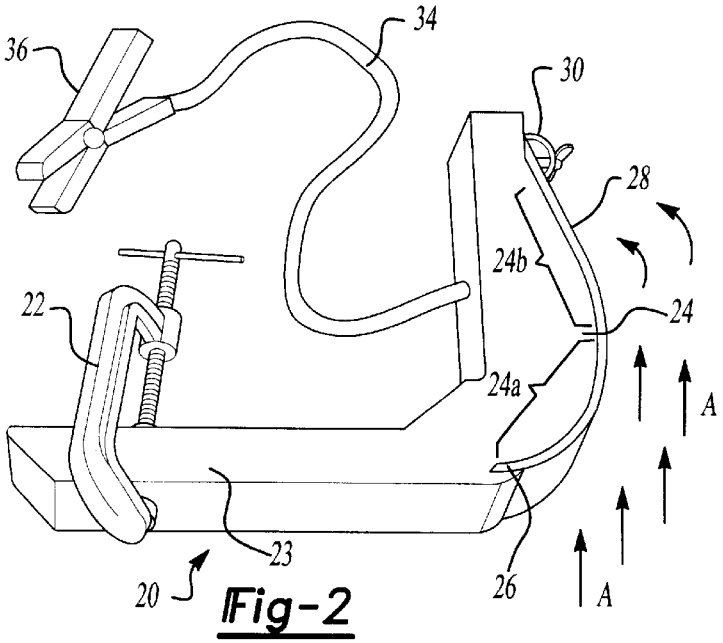
FIG. 2 is a perspective view of a test fixture according to the principles of the present invention.

With reference to FIG. 2, the test fixture 20 will now be described in greater detail. The test fixture 20 includes a base member having a mounting arm portion 23 and a curved surface portion 24. The mounting arm portion 23 is adapted to be mounted to the spray target 16 by the C clamp 22. The curved surface 24 includes first and second ends. The first end is provided with a slot 26 which is adapted for receiving a first end of a test panel 28. A clamp 30 is provided at a second end of the curved surface 24 and is adapted for receiving a second end of the test panel 28.

Figure 3A:
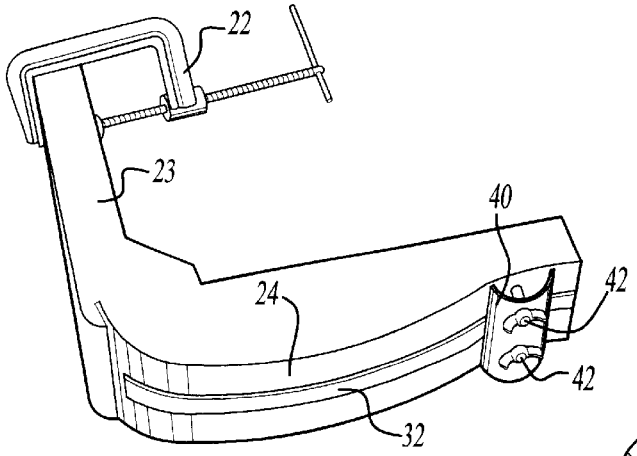
FIG. 3A is a perspective view of the test fixture according to the principles of the present invention, with the test panel removed.
Figure 3B:
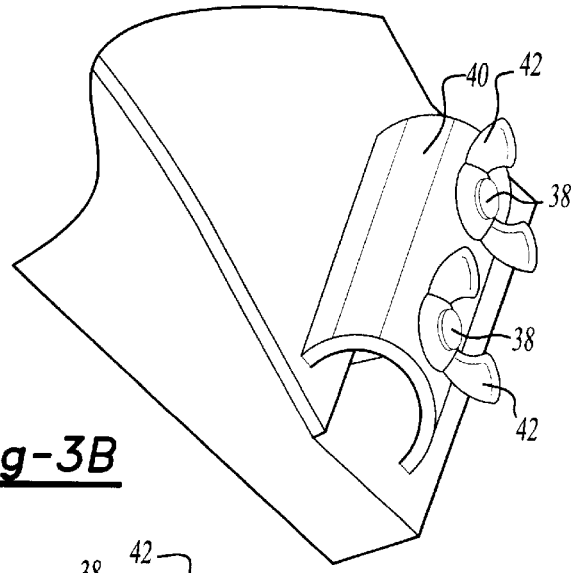
FIG. 3B is a perspective view of the clamp device according to the principles of the present invention.

As best shown in FIG. 3A, a grounding strap 32 is securely mounted to the curved surface 24. A grounding wire 34 is connected to the grounding strap 32 and a grounding clamp 36 is connected to the grounding wire 34. Without intending to be limited by theory, it is believed that the ground member may be necessary for dissipating electric charge from the coating particles which build up on the test panel 28. With reference to FIG. 3B, the clamp 30 disposed at the second end of the curved surface 24 includes a pair of threaded fasteners 38 which receive a curved plate 40 which is adjustably mounted to the threaded fasteners 38 by a pair of wing nuts 42. Fasteners 38 and wing nuts 42 can be made from a non-ferrous material. It should be understood that although a slot 26 and clamp 30 is provided for securing the test panel 28 to the curved surface 24 of the test fixture 20, alternative clamping or mounting techniques may be utilized for securing the test panel 24 in place as would be well known in the art.

Figure 4:
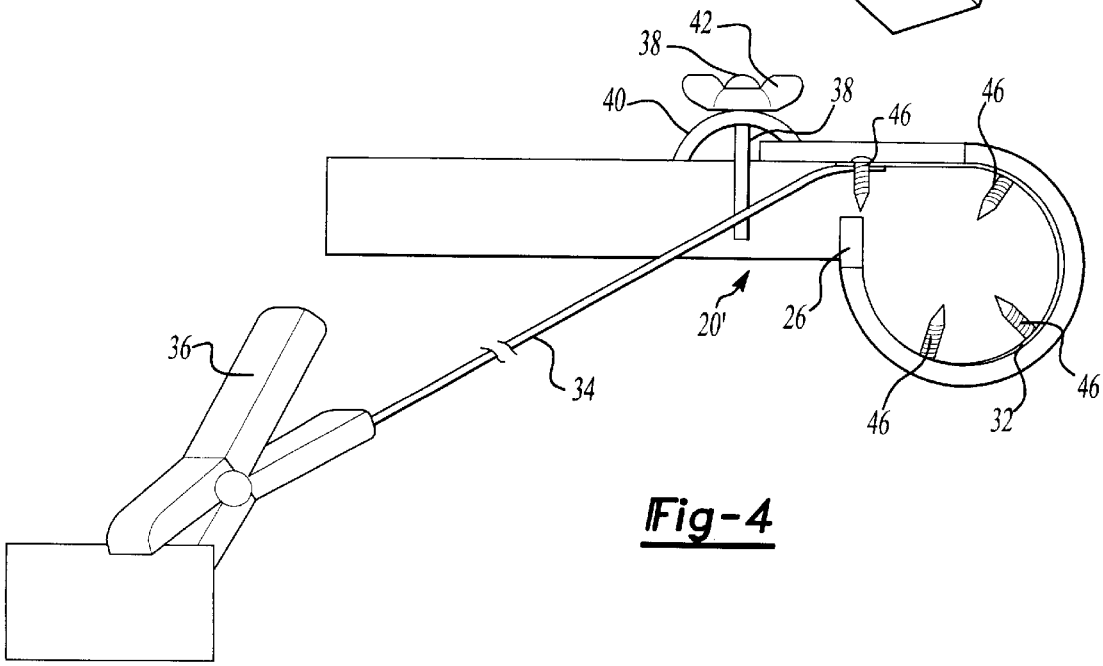
FIG. 4 is a schematic illustration of a test fixture according to the principles of the present invention, having a different shape.

The grounding strap 32 can be mounted to the curved surface 24 by adhesives, threaded fasteners such as screws 46, as shown in FIG. 4, or other well known fastening techniques. The grounding wire 34 can be attached directly to the grounding strap 32 or wrapped around one of the screws 46 which are utilized for securing the grounding strap 32 in place.

The test fixture 24, according to the present invention, allows lab personnel to mount test panels in a fixed repeatable position relative to a spray gun in order to measure the electrostatic wrap potential of an electrostatically applied coating. With reference to FIG. 2, the spray direction of the electrostatic applied coating is illustrated by arrows A. The curved surface 24 of the test fixture 20 includes a forward portion 24*a* closest to the spraying device 14 which is in a direct path of the sprayed electrostatic coating. The curved surface 24 further includes a rearward portion 24*b* further from the spraying device 14 which is not in a direct spray path of the sprayed electrostatic coating. As the electrostatic coating passes by the forward portion 24*a* of the curved portion without adhering thereto, the electrostatic charge of the coating causes the coating particles to be drawn toward the rearward portion 24*b* of the curved surface and adhere to the panel 24. The ability of a coating to curve away from a direct spray path and adhere to a panel as illustrated in FIG. 2 is referred to as the electrostatic wrap potential. Since the amount of electrostatic wrap potential for different coatings can vary, the test fixture and test panels, according to the principles of the present invention, can be utilized to quantify the wrap potential of a coating. In other words, the further along the rearward portion 24*b* of the curved surface 24 that a coating is applied, the greater the electrostatic wrap potential of that coating is. FIG. 4 illustrates a test fixture 20' which has a different curved surface from the one depicted in FIGS. 1–3.

Figure 5:
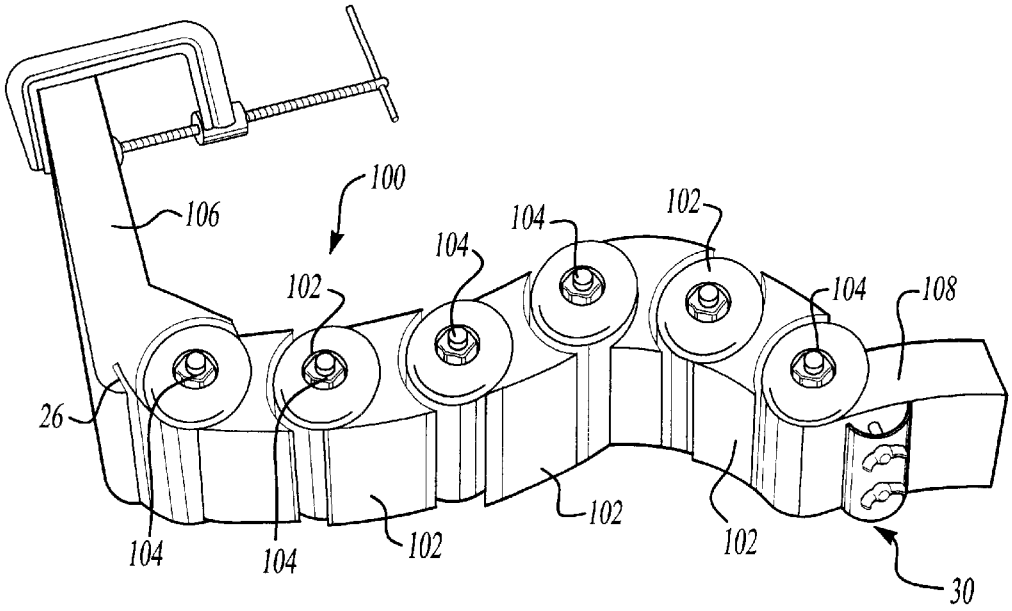
FIG. 5 is a perspective view of a test fixture according to the principles of the present invention, having a curvature of the curved surface which is adjustable.
Figure 6:
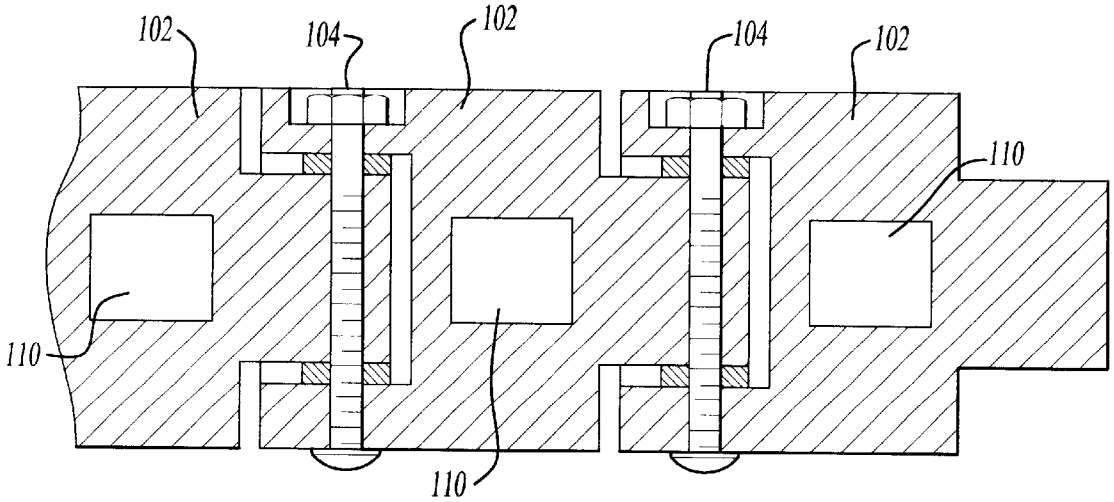
FIG. 6 is a cross-sectional view showing the adjustable linkage of the test fixture shown in FIG. 5.

FIGS. 5 and 6 illustrate how the test fixture can be constructed to have a curved surface which is adjustable. In particular, the test fixture 100 shown in FIG. 5 includes a plurality of adjustable linkages 102 connected in series. The linkages 102 are connected to one another by a non-conductive threaded fastener 104 which can be adjusted to provide a clamping force between the linkages 102 in order to secure the linkages relative to one another. The adjustable linkages 102 are connected to a base mounting portion 106 which is adapt to be mounted to the spray target 16, as shown in FIG. 1. An end linkage 108 is provided for supporting a clamp 30 as described above. A slot 26 is provided in the base mounting portion 106. A test panel is mounted along the adjustable curved surface and secured at opposite ends by the slot 26 and clamp 30. One or more of the linkages 102 can be provided with a grounding member 110 which is adapted to be in contact with a test panel. The use of the test fixture with an adjustable curvature can be utilized to represent different style production parts without requiring that an entirely new test fixture be designed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrostatic spray fixture for use with a test panel having a first and second planar surface, comprising:

a base member having a curved surface adapted to support one of the first and second planar surfaces such that the test panel is in a curved position thereon; and a ground member disposed on said curved surface and adapted to contact said one of the first and second planar surfaces of the test panel mounted to said curved surface.

2. The fixture according to claim 1, wherein said base member includes a slot, disposed at one end of said curved surface, adapted for receiving a first end of a test panel.

3. The fixture according to claim 2, further comprising a clamp mounted at a second end of said curved surface.

4. The fixture according to claim 1, further comprising a ground wire and clamp attached to said ground member.

5. The fixture according to claim 1, wherein a curvature of said curved surface is adjustable.

6. An electrostatic spray fixture for test panels having first and second planar surfaces, comprising:

a base member defining a curved surface on a portion thereof, said curved surface having a first end provided with a slot therein adapted to receive a first end of a test panel;

a clamp mounted at a second end of said curved surface for receiving a second end of a test panel; and wherein said slot and said clamp retain the test panel in a curved state with one of said first and second planar surfaces being disposed against said curved surface of said base member.

7. The fixture according to claim 6, further comprising an electrical ground member disposed on said curved surface and adapted to contact a test panel mounted to said curved surface.

8. The fixture according to claim 7, further comprising a ground wire and clamp attached to said ground member.

9. The fixture according to claim 6, wherein a curvature of said curved surface is adjustable.

10. An electrostatic spray fixture for test panels, having first and second planar surfaces comprising:

a base member defining a curved surface on a portion thereof, said curved surface having a first end and a second end, said first end including a first mounting portion adapted for receiving a first end of a test panel, said second end including a second mounting portion adapted for receiving a second end of the test panel for supporting the test panel in a curved state with one of said first and second planar surfaces disposed along said curved surface.

11. The fixture according to claim 10, wherein said base member includes a mounting portion adapted for mounting said fixture to a spray target.

12. The fixture according to claim 10, further comprising an electrical ground member disposed on said curved surface.

13. The fixture according to claim 12, further comprising a ground wire and clamp attached to said ground member.

14. An electrostatic spray fixture for test panels, comprising:

a base member defining a curved surface on a portion thereof, said curved surface having a first end and a second end, said first end including a first mounting portion adapted for receiving a fist end of a test panel, said second end including a second mounting portion adapted for receiving a second end of a test panel for supporting a test panel along said curved surface;

wherein a curvature of said curved surface is adjustable.

15. In combination, an electrostatic spray fixture and a test panel, comprising:

a test panel having a first planar surface and a second planar surface;

an electrostatic spray fixture including a base member of the electrostatic spray fixture having a curved surface adapted to support said test panel;

wherein said test panel is bent along said curved surface so that one of said first and second planar surfaces is disposed against said curved surface of said base member.

* * * * *